US005693444A

United States Patent [19]

Takagi et al.

[11] Patent Number: 5,693,444

[45] Date of Patent: Dec. 2, 1997

[54] ELECTROSTATIC-IMAGE DEVELOPER AND IMAGE FORMING PROCESS

[75] Inventors: Masahiro Takagi; Akihiro Iizuka; Satoru Ishigaki; Masanori Ichimura, all of Minami Ashigara, Japan

[73] Assignee: Fuji Xerox Co., Ltd., Tokyo, Japan

[21] Appl. No.: 762,875

[22] Filed: Dec. 12, 1996

[30] Foreign Application Priority Data

Dec. 18, 1995 [JP] Japan ..... 7-328652

[51] Int. Cl.[6] ..... G03G 9/08

[52] U.S. Cl. ..... 430/106.6; 430/110; 430/111; 430/126

[58] Field of Search ..... 430/106.6, 110, 430/111, 126, 108

[56] References Cited

U.S. PATENT DOCUMENTS

| | | | |
|---|---|---|---|
| 4,485,162 | 11/1984 | Imamura et al. | 430/106.6 |
| 5,120,631 | 6/1992 | Kanbayashi et al. | 430/111 |
| 5,164,774 | 11/1992 | Tomita et al. | 430/111 |
| 5,296,324 | 3/1994 | Akagi et al. | 430/111 |
| 5,342,721 | 8/1994 | Akamatsu | 430/108 |

FOREIGN PATENT DOCUMENTS

| | | |
|---|---|---|
| 58-215664 | 12/1983 | Japan . |
| 1-163758 | 6/1989 | Japan . |
| 6-110253 | 4/1994 | Japan . |
| 7-225497 | 8/1995 | Japan . |

*Primary Examiner*—Christopher D. Rodee
*Attorney, Agent, or Firm*—Oliff & Berridge

[57] ABSTRACT

An electrostatic-image developer which comprises a toner and a carrier comprising core particles coated with a coating resin, wherein the toner comprises toner particles having a volume-average particle diameter of from 3 to 9 μm and having a specific particle diameter distribution, at least 20% of the total surface area of the toner particles is covered with (a) an external additive having an average particle diameter of from 20 nm to 100 nm, and at least 40% of the total surface area of the toner particles is covered with (b) an external additive having an average particle diameter of from 7 nm to 20 nm, and wherein the core particles of the carrier are magnetic particles formed from a composition comprising 100 parts by weight of a ferrite component represented by the following formula (3):

$$(M_yO)_{100-x}(Fe_2O_3)_x \quad (3)$$

(wherein M is a metal atom selected from the group consisting of Li, Mg, Ca and Mn; x is from 45 to 95 mol %; and y is 1 or 2) and from 0.01 to 10 parts by weight of an oxide of at least one element selected from the group consisting of Groups IA, IIA, IIIA, IVA, VA, IIIB, IVB, and VB of the periodic table by granulating the composition and sintering the granules, and the magnetic particles have a silicon content of from 500 to 5,000 ppm. An image forming process using the developer is also disclosed.

18 Claims, No Drawings

ELECTROSTATIC-IMAGE DEVELOPER AND IMAGE FORMING PROCESS

FIELD OF THE INVENTION

The present invention relates to an electrostatic-image developer for use as a two-component developer for developing electrostatic images formed by electrophotography, electrostatic recording, etc. The present invention further relates to a process for image formation using the developer.

BACKGROUND OF THE INVENTION

Processes for converting image information into visible images via electrostatic images, including electrophotography, are presently utilized in various fields. In electrophotography, an electrostatic latent image is formed on a photoreceptor through charging and exposure steps and the electrostatic latent image is visualized by development with a developer comprising a toner, followed by transfer and fixing. The developers for use in this process include two-component developers comprising a toner and a carrier and one-component developers consisting of a toner alone, e.g., a magnetic toner. The two-component developers have advantages of such as good controllability because the functions thereof have been allotted to the carrier and the toner; the carrier functions in stirring, transport, and charging of the developer. Due to those advantages, the two-component developers are generally used.

In particular, developers employing a resin-coated carrier have excellent electrification controllability and can be relatively easily improved in environmental dependence and long-term stability. Ferrites are frequently used as core particles, for example, because they are lightweight, have good flowability, and are excellent in the control of magnetic characteristics. Although cascade development and other development methods have long been used, magnetic brush development has become the main development method, in which magnetic rolls are used as a means for developer carrier.

The technique of exposing a photoreceptor with a small laser beam to form an electrostatic latent image on the photoreceptor has progressed in recent years, so that finer electrostatic latent images can be obtained. With the increasing fineness of electrostatic latent images, size reduction in both toner particles and carrier particles has also been attempted in order to faithfully develop electrostatic latent images to output higher-quality images. In particular, the technique of employing a toner having a reduced average particle diameter to improve image quality is frequently used. In the case where a latent image is formed on an organic photoreceptor with a laser and developed by reversal development, the polarity of the carrier particles is generally positive and that of the toner particles is generally negative.

Although use of a toner having a reduced average particle diameter is an effective technique for improving image quality, two-component developers have various problems which should be mitigated concerning the frictional electrification characteristics thereof as follows. First, since the amount of toner charges per unit weight of a toner (g/m), which is generally called tribo value, is inversely proportional to image density in the formation of a color image by electrophotography through the development of an electrostatic latent image, it is diffficult to obtain a desired image density with toner particles having a reduced particle diameter because such a toner has an enlarged specific surface area and an increased tribo value. Second, since the amount of charges per toner particle decreases with decreasing toner particle diameter, use of a finer toner tends to cause fogging in non-image areas. It is thought that since these problems still remain unsolved, there is a particle diameter range in which a sufficient image density is inconsistent with fogging prevention. Third, the build up speed of frictional electrification is low, because the reduced toner particle diameter has resulted in an increased proportion of the total surface area of the toner to the total surface area of the carrier. Consequently, when a two-component developer containing a finer toner is used under such conditions that a high-density image such as a color photographic image is formed and toner consumption is considerably large, then lowly charged toner particles are readily generated and this tends to cause image-quality troubles such as a density unevenness and toner fogging. Fourth, since smaller average toner particle diameters result in enhanced toner adhesion to photoreceptors, finer toners tend to suffer transfer failure and this often causes image defects such as the failure of image formation called hollow character and difficulties in obtaining a desired color tone due to transfer unevenness of superimposed images.

On the other hand, magnetic brush development using a two-component developer has a problem to be mitigated concerning unstable image quality which is thought to be attributable to developer deterioration in electrification characteristics. A developer is apt to suffer a deterioration in electrification characteristics as a result of tenacious adhesion of a toner component to the resin coating layer of the carrier, peeling of the resin coating layer, etc. Two-component developers may further suffer the so-called charging-up phenomenon in which the developer is charged in an excessively large amount when mixed in a developing device in the initial stage of the use thereof. When charging-up occurs, carrier particles are apt to adhere to the background of an image, resulting in a rough image. In the case where two-component developers are used to form an image by superimposing multiple color images, there is a problem that when the amount of charges in each of those developers of different colors fluctuates, the amounts of the respective color toners used in development fluctuate. As a result, the images formed by superimposing multiple color images have different colors which fluctuate with output operations.

To solve such various problems concerning the frictional electrification characteristics of two-component developers, investigations have conventionally been made mainly on external toner additives and carrier-coating resins. On the other hand, the phenomenon in which the contribution of the frictional electrification characteristics of carrier core particles themselves is enhanced with the lapse of time probably due to the depth of electrification is thought to be an important factor which makes the electrification characteristics of the carrier unstable. However, few definite proposals have been made on this problem, and there is much room for improvement in the frictional electrification characteristics of core particles.

Conventional soft ferrites, which contain a transition metal oxide as a major component, can be regarded as n-type semiconductors containing an electron-donating substance. It is hence thought that soft ferrites tend to be positively charged by friction. In fact, however, when soft ferrite core particles are used as a carrier without being coated with a resin, the amount of positive charges increases in the beginning of mixing but it decreases considerably with the lapse of mixing time. Even when the core particles are coated with a resin and then used as a carrier, the coated carrier undergoes the phenomenon in which the amount of charges increases and then decreases. The above phenomenon is a great factor which makes carrier electrification characteristics unstable. This adverse influence of core particles on carrier electrification characteristics is produced not only in the case where the core particles have been coated with a thin resin layer or are partly exposed on the carrier surface, but also in the case where the core particles have been uniformly and completely covered with a resin film having a thickness of 1 μm or larger.

SUMMARY OF THE INVENTION

The present invention has been achieved in order to solve the above-described problems of conventional two-component developers concerning frictional electrification characteristics.

Namely, the present invention has been achieved in order to more faithfully reproduce a latent image to obtain a high-quality image in electrophotography using a two-component developer. More particularly, the present invention has been achieved for the purposes of: maintaining the amount of charges in a negatively charged color toner having a small diameter at a desired value to stabilize the developing properties thereof; regulating the toner so as to faithfully develop a latent image to form a satisfactory transferred toner image and give a high-quality image; and preventing carrier adhesion, density unevenness, toner fogging, etc. to obtain images of excellent quality.

Accordingly, an object of the present invention is to provide an electrostatic-image developer which is excellent in electrification characteristics and developing properties and is capable of faithfully developing a latent image to give a high-quality image free from carrier adhesion, density unevenness, toner fogging, etc. Another object of the present invention is to provide an electrostatic-image developer containing a negatively charged color toner having a small diameter which has been regulated so as to maintain a desired value of the charge amount and to retain stable developing properties. Still another object of the present invention is to provide an image forming process which can give a high-quality color image through magnetic brush development.

As a result of investigations, the present inventors have found that image quality can be improved more effectively when a small-diameter toner is regulated so that the percentages of covering of the toner particles with external additives are within given ranges and that the toner has a particle diameter distribution within a given range. They have also found that the composition of the material of carrier core particles greatly contributes to the frictional electrification characteristics of a developer containing a toner having a reduced particle diameter. It has been further found that for eliminating the disadvantages in using a ferrite as a carrier, it is important to regulate the kinds and amounts of metal elements contained in a ferrite component in core particles. Specifically, use of a metal element having an electronegativity not higher than a given value, i.e., not higher than 1.5 in terms of Pauling electronegativity, as a major component of a ferrite component has been found to be effective in obtaining excellent electron-donating properties and satisfactory positive-electrification characteristics. In addition, core particles containing a given amount of Si besides those major components have been found to be preferable for elevating the build up speed of friction electrification with a small-diameter toner. The present invention, which has been achieved based on these findings, has succeeded in accomplishing the above subjects by employing the constitutions shown below.

The present invention provides an electrostatic-image developer which comprises a toner and a carrier comprising core particles coated with a coating resin, wherein the toner comprises toner particles having a volume-average particle diameter of from 3 to 9 μm and having a particle diameter distribution satisfying the following expressions (1) and (2):

$$D16v/D50v \leqq 1.475-0.036 \cdot D50v \quad (1)$$

$$D50p/D84p \leqq 1.45 \quad (2)$$

(wherein D16v and D50v represent, in terms of absolute value, a cumulative 16% diameter (μm) and a cumulative 50% diameter (μm), respectively, of a cumulative volume particle diameter distribution of the toner particles depicted from the maximum particle diameter and D50p and D84p represent, in terms of absolute value, a cumulative 50% diameter (μm) and a cumulative 84% diameter (μm), respectively, of a cumulative population particle diameter distribution of the toner particles depicted from the maximum particle diameter), and at least 20% of the total surface area of the toner particles is covered with (a) an external additive (first external additive) having an average particle diameter of from 20 nm to 100 nm, excluding 100 nm, and at least 40% of the total surface area of the toner particles is covered with (b) an external additive (second external additive) having an average particle diameter of from 7 nm to 20 nm, excluding 20 nm, the total percentage of the coverage with the two external additives (a) and (b) is from 60% to 120%, excluding 120%, based on the total surface area of the toner particles, and wherein the core particles of the carrier are magnetic particles formed from a composition comprising 100 parts by weight of a ferrite component represented by the following formula (3):

$$(M_yO)_{100-x}(Fe_2O_3)_x \quad (3)$$

(wherein M represents at least one metal atom selected from the group consisting of Li, Mg, Ca and Mn; x represents a mole percentage of 45 to 95%; and y represents 1 or 2) and from 0.01 to 10 parts by weight of an oxide of at least one element selected from the group consisting of Groups IA, IIA, IIIA, IVA, VA, IIIB, IVB, and VB of the periodic table by granulating the composition and sintering the granules, and the magnetic particles have a silicon content of from 500 to 5,000 ppm.

The present invention further provides an image forming process which comprises a latent-image-forming step for forming a latent image on a latent-image holder, a development step for developing the latent image with a developer, and a transfer step for transferring the developed toner image to a receiving material. The developer used is the electrostatic-image developer as described above.

DETAILED DESCRIPTION OF THE INVENTION

First, the toner contained in the electrostatic-image developer of the present invention is explained. The toner comprises toner particles comprising a binder resin and a colorant as the main components, and are covered with external additives. Examples of binder resins which can be used in the toner include homopolymers and copolymers of monomers such as styrene and styrene derivatives, e.g., chlorostyrene; monoolefins, e.g., ethylene, propylene, butylene and isobutylene; vinyl esters, e.g., vinyl acetate, vinyl propionate, vinyl benzoate and vinyl butyrate; esters of aliphatic α-methylene monocarboxylic acids, e.g., methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; vinyl ethers, e.g., vinyl methyl ether, vinyl ethyl ether and vinyl butyl ether; and vinyl ketones, e.g., vinyl methyl ketone, vinyl hexyl ketone and vinyl isopropenyl ketone. Especially representative binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. Examples of the binder resin further include polyesters, polyurethanes, epoxy resins, silicone resins, polyamides, modified rosins and paraffin waxes.

A known dye or pigment may be used as the colorant. Representative examples thereof include carbon black, aniline blue, Calco Oil Blue, chrome yellow, ultramarine blue, Du Pont Oil Red, quinoline yellow, methylene blue chloride, copper phthalocyanine, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3. If necessary, known additives such as a charge control agent may be incorporated.

Examples of the external additives with which the toner particles are covered include fine powders of inorganic materials such as $TiO_2$, $SiO_2$, $Al_2O_3$, MgO, CuO, $SnO_2$, $CeO_2$, $Fe_{23}$, BaO, $CaO.SiO_2$, $K_2O(TiO_2)_n$, $Al_2O_3.2SiO_2$, $CaCO_3$, $MgCO_3$, $BASO_4$, $MgSO_4$, $MoS_2$, silicon carbide, boron nitride, carbon black, graphite, and graphite fluoride and fine powders of polymers such as polycarbonates, poly(methyl methacrylate), and poly(vinylidene fluoride). These external additives may be used alone or as a mixture of two or more thereof.

The toner particles for use in the present invention, which comprise the ingredients described above, have a volume-average particle diameter of from 3 to 9 μm. If toner particles having a volume-average particle diameter smaller than 3 μm are used, the amount of charges per toner particle is reduced, resulting in poor image quality with considerable fogging. If toner particles having a volume-average particle diameter exceeding 9 μm are used, the toner gives an image having impaired graininess and a rough surface.

For obtaining a high-quality image by more faithfully reproducing an electrostatic latent image formed on a photoconductive photoreceptor, the toner should have a particle diameter distribution satisfying expressions (1) and (2) given above. Although a detailed mechanism therefor has not been elucidated, use of a toner having a wide particle diameter distribution results in considerable black spots of toner particles. In particular, the dusting of large toner particles causes significant image quality deterioration. Namely, for obtaining high-quality images, it is necessary to regulate the larger-particle-side particle diameter distribution within the range defined by expression (1). In the case of a toner having a wide particle diameter distribution on the smaller-particle side, such a toner tends to suffer transfer failure because it is difficult that external additives adhere to smaller toner particles. Consequently, the smaller-particle-side particle diameter distribution should also be regulated within the range defined by expression (2).

That is, regulating a toner so as to have a particle diameter distribution in which the values of D16v/D50v and D50p/D84p are within the respective ranges specified above is more effective in image quality improvement than merely reducing the average toner particle diameter. If the particle diameter distribution on the larger-particle side does not satisfy expression (1), that is, if D16v/D50v exceeds the value 1.475−0.036×D50v, this also results in the formation of an image having impaired graininess and a rough surface. In addition, since a large proportion of external additives adhere to larger toner particles, the amount of the external additives adhering to the toner particles having the central particle diameter is smaller than the desired amount shown later, resulting in impaired transferability.

If the particle diameter distribution on the smaller-particle side does not satisfy expression (2), that is, if D50p/D84p exceeds 1.45, the toner gives a somewhat fogged image, which tends to have impaired graininess. In addition, since external additives less adhere to smaller toner particles, such a toner contains an increased proportion of toner particles in which the percentage of covering with the external additives is lower than the desired value, resulting in impaired transferability.

In the present invention, at least 20% of the total surface area of the toner particles should be covered with a first external additive having an average particle diameter of from 20 nm to 100 nm, excluding 100 nm, and at least 40% of the total surface area of the toner particles should be covered with a second external additive having an average particle diameter of from 7 nm to 20 nm, excluding 20 nm. Moreover, the total percentage of covering with the two external additives should be from 60% to 120%, excluding 120%, based on the total surface area of the toner particles. Values of the percentage of covering of a toner with an external additive are based on the integrated total surface area of the toner particles which is calculated using the following equation from found values obtained with a Coulter counter for all channels:

$$St=\Sigma\pi d_x^2 \cdot n_x$$

(St: total surface area, $d_x$: particle diameter, $n_x$: the number of toner particles for each channel).

Toners having small average particle diameters more tenaciously adhere to photoreceptors than toners having larger average particle diameters, and hence tend to have impaired transferability. However, by regulating the percentages of covering of a toner with two external additives having different average particle diameters as described above, the toner can form a satisfactory transferred image as long as the average particle diameter and particle diameter distribution thereof are within the respective ranges specified above. Namely, the first external additive, which has an average particle of from 20 nm to 100 nm, excluding 100 nm, should cover at least 20% of the total surface ares of the toner particles. If the percentage of covering with the first external additive is lower than 20%, the toner/photoreceptor contact area is increased, resulting in reduced adhesion strength and insufficient transferability.

The second external additive, which has an average particle diameter of from 7 to 20 nm, excluding 20 nm, should cover at least 40% of the total surface area of the toner particles. If the percentage of the coverage with the second external additive is lower than 40%, this produces adverse influences such as impaired toner flowability and toner aggregation.

Further, if the total percentage of the coverage with the two external additives is lower than 60% of the total surface area of the toner particles, sufficient transferability is not obtained. If it is not lower than 120%, particles of the external additives tend to transfer or adhere to a latent-image holder such as a photoreceptor, resulting in image troubles such as white dots and density unevenness. The term "total percentage of the coverage with external additives" herein means the percentage of the coverage calculated from the addition amounts of the external additives. Consequently, in the case where external additives were added in such amounts as to be capable of covering 120% of the toner surface area, the percentage of the coverage therewith is taken as 120%.

The percentage of the coverage with external additives is calculated according to the following expression:

$$f=(\sqrt{3}/2\pi)\times(D/d)\times(\rho_c/\rho_r)\times C$$

wherein f represents a coverage of an external additive; D and d represent diameters of a toner particle and the external additive, respectively; $\rho_c$ and $\rho_r$ represent specific gravities of the toner particle and the external additive, respectively; and C represents a weight percentage of the external additive.

On the other hand, the carrier for use in the present invention is produced using a ferrite component represented by formula (3) given above. From 45 to 95 mol % of the ferrite component is accounted for by $Fe_2O_3$. The proportion of $Fe_2O_3$ should be in the above range because $Fe_2O_3$ proportions outside that range result in precipitation of unreacted substances during ferrite formation and in insufficient magnetic susceptibility. The carrier contains a metal element having a Pauling electronegativity of 1.5 or lower, such as Li, Mg, Ca and Mn, as a component of the ferrite component. The incorporation of the metal element enables the carrier to have excellent electron-donating properties and satisfactory positive electrification characteristics. Although the reason for the above has not been fully elucidated, the following explanation may be possible. For example, when a prior art ferrite component such as Cu or Zn is used as described in, e.g., JP-A-1-163758 and JP-A-6-110253 (the term "JP-A" as used herein means an "unexamined published Japanese patent application"), the resulting carrier is inhibited from being positively electrified. This phenomenon is thought to be attributable to the enhanced tendency to accept electrons due to a combination of, for example, the relatively high electronegativity of Cu or Zn (Pauling electronegativity: Cu=1.9, Zn=1.6) and the relatively small atomic volume thereof (the volume of the simple substance consisting of the Avogadro's number of atoms), i.e., the high density of atoms.

To the ferrite component is added another metal oxide in an amount of from 0.01 to 10% by weight, preferably from 0.05 to 8% by weight, in order to control crystal growth on the surface of core particles and the surface roughness thereof or to control the density of the particles. This metal oxide is an oxide of at least one element selected from the group consisting of Groups IA, IIA, IIIA, IVA, VA, IIIB, IVB, and VB of the periodic table. Examples thereof include $Li_2O$, BaO, SrO, $Al_2O_3$, $TiO_2$, $SiO_2$ and $Bi_2O_5$. Of these, $Li_2O$, SrO, $Al_2O_3$, $SiO_2$ and $Bi_2O_5$ are preferred.

For producing ferrite particles, known methods can be used. Examples of the method include a method which comprises mixing a pulverized ferrite composition with a binder, water, a dispersant, an organic solvent, etc., forming particles from the mixture by spray drying or fluidization granulation, sintering the particles with a rotary kiln or batch incinerator, and classifying the sintered particles by screening to obtain carrier core particles having a regulated particle diameter distribution. It is possible to regulate the core particles so as to have a desired value of volume resistivity, for example, by regulating the partial pressure of oxygen in the sintering step or by further conducting a step in which the sintered particles are subjected to a surface oxidation or reduction treatment.

The magnetic particles thus formed through granulation and sintering should have a silicon content of from 500 to 5,000 ppm. The preferred range of the silicon content thereof is from 1,000 to 3,000 ppm. If the silicon content thereof exceeds 5,000 ppm, the amount of charges attenuates greatly. If the silicon content thereof is lower than 500 ppm, the build up speed of electrification is low. The content of silicon can be determined by fluorescent X-ray spectrometry.

In general, silicon in the form of an oxide is added to a ferrite composition in order to use the silicon for accelerating the growth of crystal grains during the reaction for sintering and ferrite formation. In the present invention, however, the silicon oxide remaining at the grain boundaries is presumed to accelerate the movement of charge particles generated at the interface between the carrier and the toner. Carrier core particles having a silicon content within the above range give satisfactory results.

In the present invention, core particles having a nearly spherical shape and an average particle diameter of usually about from 20 to 120 μm are preferably used for development with an insulating magnetic brush, while core particles of irregular shapes and an average particle diameter of preferably from 20 to 150 μm may be used for development with a conductive magnetic brush.

The carrier is formed by treating the above-described core particles with a coating resin. Examples of the coating resin include homopolymers and copolymers of: fluorinated vinyl monomers such as vinylidene fluoride, tetrafluoroethylene, hexafluoropropylene, monochlorotrifluoroethylene, monofluoroethylene and trifluoroethylene; styrene and derivatives thereof such as chlorostyrene and methylstyrene; aliphatic α-methylene monocarboxylic acids such as acrylic acid, methacrylic acid, methyl acrylate, propyl acrylate, butyl acrylate, 2-ethylhexyl acrylate, lauryl acrylate, methyl methacrylate, ethyl methacrylate and butyl methacrylate; nitrogenous acrylic acid derivatives such as dimethylaminoethyl methacrylate; nitriles such as acrylonitrile and methacrylonitrile; vinylpyridines such as 2-vinylpyridine and 4-vinylpyridine; vinyl ethers; vinyl ketones; and olefins such as ethylene, propylene and butadiene. Examples of the coating resin further include silicone resins such as methyl silicone resins and methyl phenyl silicone resins. Also useful are polyesters produced from bisphenol, glycol, etc. These resins may be used as a mixture of two or more thereof. Preferred of these resins in view of easiness of coating, coating film strength, etc. are homopolymers or copolymers of fluorinated vinyl monomers, styrene and derivatives thereof and aliphatic α-methylene monocarboxylic acids, and silicone resins. Especially preferred are copolymers of styrene or derivatives thereof with aliphatic α-methylene monocarboxylic acids.

The total amount of the coating resin used is preferably from 0.1 to 5% by weight, more preferably from 0.3 to 3.0% by weight, based on the amount of the carrier in view of attaining all of image quality, prevention of secondary troubles, and electrification characteristics.

For coating core particles with the resin described above, a heating kneader, heating Henschel mixer, UM mixer, planetary mixer, or the like may be used.

The process for image formation of the present invention using the above-described electrostatic-image developer is then explained. The image-forming process of the present invention, which can be suitably used according to dry processes, comprises a latent-image-forming step for forming a latent image on a latent-image holder, a development step for developing the latent image on the latent-image holder, and a transfer step for transferring the resulting toner image from the latent-image holder to a receiving material.

The latent-image-forming step can be conducted by a known method. Electrophotography or electrostatic recording may be used to form an electrostatic latent image on a latent-image holder, such as a photosensitive layer or a dielectric layer. Known latent-image holders can be used such as Se photoreceptors, organic photoreceptors, amorphous silicon photoreceptors, and photoreceptors of these types which have an overcoat. The formation of a latent image can be conducted by a known method.

The latent image formed is visualized by the subsequent development step. In the present invention, the developer used in the development step is an electrostatic-image developer comprising the above-described carrier and toner. In the transfer step, the visualized toner image is transferred to a receiving material, e.g., paper, in an ordinary way and then fixed with heating. In a cleaning step, the toner remaining on the latent-image holder is removed in preparation for the next cycle.

The present invention is explained below in more detail by reference to Examples, but the invention should not be construed as being limited to these Examples. In the Examples, all parts are given by weight. Particle diameter distribution was determined with Coulter Counter Type TA2. For image quality evaluation, a modified A-color 635 (manufactured by Fuji Xerox Co.,.Ltd.) was used.

1) Production of Toners (Production of Toner A)

| | |
|---|---|
| Polyester binder resin: (terephthalic acid-bisphenol A condensate; $M_w$, 10,000) | 95 parts |
| Colorant: C.I. Pigment Red 57:1 | 5 parts |

The above ingredients were kneaded with a twin-screw kneader, and the resulting mixture was pulverized and classified to obtain toner particles having a volume-average particle diameter of 6.3 μm. These toner particles had a D16v/D50v of 1.22 and a D50p/D84p of 1.38. Fine silica particles having an average particle diameter of 45 nm and treated with 10 wt % hexamethylenedisilazane were added as a first external additive to the obtained toner particles in such an amount as to result in a percentage of the coverage therewith of 35% based on the total surface area of the toner particles. Further, fine titanium oxide particles having an average particle diameter of 15 nm and treated with 12 wt % trimethoxydecylsilane were added as a second external additive in such an amount as to result in a percentage of the coverage therewith of 50% based on the total toner particle surface area. The resulting mixture was treated with a Henschel mixer and then screened with a screen having an opening size of 45 μm.

(Production of Toner B)

Toner particles were obtained in the same manner as in the production of Toner A, except that the colorant was replaced with C.I. Pigment Yellow 17, that the colorant/binder resin weight ratio was changed so as to result in a colorant amount of 8 parts by weight, and that in the pulverization and classification steps, the volume-average particle diameter of the toner particles was regulated to 4.8 μm. These toner particles had a D16v/D50v of 1.27 and a D50p/D84p of 1.37. Fine titanium oxide particles having an average particle diameter of 30 nm and treated with 8 wt % trimethoxydecylsilane were added as a first external additive to the obtained toner particles in such an amount as to result in a percentage of the coverage therewith of 50% based on the total surface area of the toner particles. Further, fine silica particles having an average particle diameter of 9 nm and treated with 10 wt % dimethyldichlorosilane were added as a second external additive in such an amount as to result in a percentage of the coverage therewith of 60% based on the total toner particle surface area. The resulting mixture was treated with a Henschel mixer and then screened with a screen having an opening size of 45 μm.

(Production of Toner C)

Toner particles were obtained in the same manner as in the production of Toner A, except that the colorant was replaced with C.I. Pigment Blue 15:3, that the colorant/binder resin weight ratio was changed so as to result in a colorant amount of 4 parts by weight, and that in the pulverization and classification steps, the volume-average particle diameter of the toner particles was regulated to 8.2 μm. These toner particles had a D16v/D50v of 1.16 and a D50p/D84p of 1.42. Fine silica particles having an average particle diameter of 30 nm and treated with 8 wt % dimethyldichlorosilane were added as a first external additive to the obtained toner particles in such an amount as to result in a percentage of the coverage therewith of 25% based on the total surface area of the toner particles. Further, fine silica particles having an average particle diameter of 14 nm and treated with 15 wt % dimethyldichlorosilane were added as a second external additive in such an amount as to result in a percentage of the coverage therewith of 45% based on the total toner particle surface area. The resulting mixture was treated with a Henschel mixer and then screened with a screen having an opening size of 45 μm.

(Production of Toner D)

Toner particles were obtained in the same manner as in the production of Toner A, except that in the pulverization and classification steps, the volume-average particle diameter of the toner particles was regulated to 6.6 μm. These toner particles had a D16v/D50v of 1.28 and a D50p/D84p of 1.33. Fine titanium oxide particles having an average particle diameter of 30 nm and treated with 8 wt % trimethoxydecylsilane were added as a first external additive to the obtained toner particles in such an amount as to result in a percentage of the coverage therewith of 25% based on the total surface area of the toner particles. Further, fine silica particles having an average particle diameter of 9 nm and treated with 10 wt % dimethyldichlorosilane were added as a second external additive in such an amount as to result in a percentage of the coverage therewith of 80% based on the total toner particle surface area. The resulting mixture was treated with a Henschel mixer and then screened with a screen having an opening size of 45 μm.

(Production of Toner E)

Toner particles were obtained in the same manner as for Toner A, except that in the pulverization and classification steps, the volume-average particle diameter of the toner particles was regulated to 6.2 μm. These toner particles had a D16v/D50v of 1.20 and a D50p/D84p of 1.48. Fine silica particles having an average particle diameter of 45 nm and treated with 10 wt % hexamethylenedisilazane were added as a first external additive to the obtained toner particles in such an amount as to result in a percentage of the coverage therewith of 30% based on the total surface area of the toner particles. Further, fine titanium oxide particles having an average particle diameter of 15 nm and treated with 12 wt % trimethoxydecylsilane were added as a second external additive in such an amount as to result in a percentage of the coverage therewith of 40% based on the total toner particle surface area. The resulting mixture was treated with a Henschel mixer and then screened with a screen having an opening size of 45 μm.

(Production of Toner F)

Toner particles were obtained in the same manner as in the production of Toner C, except that in the pulverization and classification steps, the volume-average particle diameter of the toner particles was regulated to 9.3 μm. These toner particles had a D16v/D50v of 1.13 and a D50p/D84p of 1.28. Fine silica particles having an average particle diameter of 45 nm and treated with 10 wt % hexamethylenedisilazane were added as a first external additive to the obtained toner particles in such an amount as to result in a percentage of the coverage therewith of 20% based on the total surface area of the toner particles. Further, fine titanium oxide particles having an average particle diameter of 15 nm and treated with 12 wt % trimethoxydecylsilane were added as a second external additive in such an amount as to result in a percentage of the coverage therewith of 40% based on the total toner particle surface area. The resulting mixture was treated with a Henschel mixer and then screened with a screen having an opening size of 45 μm.

(Production of Toner G)

Toner particles were obtained in the same manner as in the production of Toner C, except that in the pulverization and classification steps, the volume-average particle diameter of the toner particles was regulated to 7.5 μm. These toner particles had a D16v/D50v of 1.22 and a D50p/D84p of 1.40. Fine titanium oxide particles having an average particle diameter of 45 nm and treated with 10 wt % hexamethylenedisilazane were added as a first external additive to the obtained toner particles in such an amount as to result in a percentage of the coverage therewith of 50% based on the total surface area of the toner particles. Further, fine silica particles having an average particle diameter of 15 nm and treated with 12 wt % trimethoxydecylsilane were added as a second external additive in such an amount as to result in a percentage of the coverage therewith of 20% based on the total toner particle surface area. The resulting mixture was treated with a Henschel mixer and then screened with a screen having an opening size of 45 μm.

(Production of Toner H)

Toner particles were obtained in the same manner as in the production of Toner B, except that in the pulverization and classification steps, the volume-average particle diameter of the toner particles was regulated to 8.0 μm. These toner particles had a D16v/D50v of 1.14 and a D50p/D84p of 1.30. Fine silica particles having an average particle diameter of 45 nm and treated with 10 wt % hexamethylenedisilazane were added as a first external additive to the obtained toner particles in such an amount as to result in a percentage of the coverage therewith of 10% based on the total surface area of the toner particles. Further, fine titanium oxide particles having an average particle diameter of 15 nm and treated with 12 wt % trimethoxydecylsilane were added as a second external additive in such an amount as to result in a percentage of the coverage therewith of 60% based on the total toner particle surface area. The resulting mixture was treated with a Henschel mixer and then screened with a screen having an opening size of 45 μm.

2) Production of Carriers (Production of Carrier a)

Production of Core Particles:

| | |
|---|---|
| Ferrite component (57 mol % $Fe_2O_3$, 32 mol % MnO, 11 mol % CaO) | 100 parts |
| $SiO_2$ | 0.6 parts |
| BaO | 3.2 parts |

Oxides as raw materials for a ferrite which had been mixed so as to have the above composition or salts which came to have the above composition after sintering were wet-mixed by means of a ball mill. The resulting mixture was dried, pulverized, subsequently calcined at 900° C. for 1 hour, and then crushed into particles of about 0.1 to 1.5 mm with a crusher. The particles were wet-ground with a ball mill to obtain a slurry. Thereto was added 0.8% poly (vinyl alcohol) as a binder. Spherical particles were formed from this slurry with a spray dryer, and the particles were sintered at 1,300° C. and then classified to obtain core particles having an average particle diameter of 48 μm. The Si content thereof was determined, and was found to be 2,800 ppm.

Coating:

| | |
|---|---|
| Toluene | 100 parts |
| Styrene/methyl methacrylate/dimethylaminoethyl methacrylate copolymer ($M_w$, 70,000; monomer ratio, 25/70/5) | 10 parts |

The above ingredients were mixed to obtain a coating solution. This solution was mixed with the core particles in an amount of 0.5% by weight in terms of the amount of the solid coating resin based on the core particles. The mixture was stirred in a vacuum kneader to remove the solvent by vacuum drying, and then screened with a screen having an opening size of 105 μm to obtain resin-coated carrier a.

(Production of Carrier b)

Production of Core Particles:

| | |
|---|---|
| Ferrite component (48 mol % $Fe_2O_3$, 32 mol % CaO, 20 mol % MgO) | 100 parts |
| $SiO_2$ | 0.2 parts |

Oxides as raw materials for a ferrite which had been mixed so as to have the above composition or salts which came to have the above composition after sintering were wet-mixed by means of a ball mill. The resulting mixture was dried, pulverized, subsequently calcined at 800° C. for 1 hour, and then crushed into particles of about 0.1 to 1.5 mm with a crusher. The particles were wet-ground with a ball mill to obtain a slurry. Thereto was added 0.8% poly (vinyl alcohol) as a binder. Spherical particles were formed from this slurry with a spray dryer, and the particles were sintered at 1,280° C. and then classified to obtain core particles having an average particle diameter of 60 μm. The Si content thereof was determined, and was found to be 950 ppm.

Coating:

| | |
|---|---|
| Toluene | 100 parts |
| Styrene/methyl methacrylate/n-butyl methacrylate copolymer ($M_w$, 55,000; monomer ratio, 30/60/10) | 10 parts |

The above ingredients were mixed to obtain a coating solution. This solution was mixed with the core particles in an amount of 0.4% by weight in terms of the amount of the solid coating resin based on the core particles. The mixture was stirred in a vacuum kneader to remove the solvent by vacuum drying, and then screened with a screen having an opening size of 105 μm to obtain resin-coated carrier b.

(Production of Carrier c)

Production of Core Particles:

| | |
|---|---|
| Ferrite component (68 mol % $Fe_2O_3$, 27 mol % MnO, 5 mol % $Li_2O$) | 100 parts |
| $SiO_2$ | 1.1 part |
| $Bi_2O_5$ | 2.5 parts |

Oxides as raw materials for a ferrite which had been mixed so as to have the above composition or salts which came to have the above composition after sintering were wet-mixed by means of a ball mill. The resulting mixture was dried, pulverized, subsequently calcined at 850° C. for 1 hour, and then crushed into particles of about 0.1 to 1.5 mm with a crusher. The particles were wet-ground with a ball mill to obtain a slurry. Thereto was added 0.8% poly (vinyl alcohol) as a binder. Spherical particles were formed from this slurry with a spray dryer, and the particles were sintered at 1,320° C. and then classified to obtain core particles having an average particle diameter of 45 μm. The Si content thereof was determined, and was found to be 4,860 ppm.

Coating:

| | |
|---|---|
| Toluene/methyl ethyl ketone (4:1) mixed solvent | 100 parts |
| Methyl methacrylate/perfluorooctylethyl methacrylate copolymer ($M_w$, 25,000; monomer ratio, 85/15) | 8 parts |

The above ingredients were mixed to obtain a coating solution. This solution was mixed with the core particles in an amount of 0.5% by weight in terms of the amount of the solid coating resin based on the core particles. The mixture was stirred in a vacuum kneader to remove the solvent by vacuum drying, and then screened with a screen having an opening size of 105 μm to obtain resin-coated carrier c.

(Production of Carrier d)

Core particles were produced and coated in the same manner as in the production of carrier a, except that $SiO_2$ was omitted from the core particle composition. Thus, resin-coated carrier d was obtained.

(Production of Carrier e)

Core particles were produced in the same manner as in the production of carrier b, except that the amount of $SiO_2$ in the core particle composition was changed to 1.5 parts. The Si content of the core particles were determined, and was found to be 7,630 ppm. The core particles were coated in the same manner as for carrier b to obtain resin-coated carrier e.

(Production of Carrier f)

Production of Core Particles:

| | |
|---|---|
| Ferrite component (53 mol % $Fe_2O_3$, 32 mol % CuO, 15 mol % ZnO) | 100 parts |
| $SiO_2$ | 0.7 parts |
| CaO | 1.3 parts |

Oxides as raw materials for a ferrite which had been mixed so as to have the above composition or salts which came to have the above composition after sintering were wet-mixed by means of a ball mill. The resulting mixture was dried, pulverized, subsequently calcined at 850° C. for 1 hour, and then crushed into particles of about 0.1 to 1.5 mm with a crusher. The particles were wet-ground with a ball mill to obtain a slurry. Thereto was added 0.8% poly (vinyl alcohol) as a binder. Spherical particles were formed from the slurry with a spray dryer, and the particles were sintered at 1,330° C. and then classified to obtain core particles having an average particle diameter of 60 μm. The Si content thereof was determined, and was found to be 3,150 ppm.

The core particles were coated in the same manner as in the production of carrier c to obtain resin-coated carrier f.

EXAMPLES 1 TO 5 AND COMPARATIVE EXAMPLES 1 TO 8

(Preparation of Developers)

Toners A to H were combined with carriers a to f as shown in Table 1 in such a proportion as to result in a toner concentration of 8% by weight. Each combination was mixed by means of a V-type mixer to obtain a two-component developer.

(Test)

The two-component developers obtained in Examples 1 to 5 and Comparative Examples 1 to 8 each was introduced into the black developing device of a printer (A-color 635, manufactured by Fuji Xerox Co., Ltd.) to conduct a test for forming monochroic images. The results obtained are shown in Table 1.

The properties shown in Table 1, i.e., graininess, fogging, unevenness of density, carrier adhesion, and transferability, were evaluated based on comparison with standard samples of five grades ranging from G1 (good) to G5 (poor). The acceptable levels for graininess are from G1 to G3. With respect to fogging, unevenness of density, carrier adhesion, and transferability, the acceptable levels are from G1 to G2, while G3 to G5 each is on a level where the image defects are conspicuous.

TABLE 1

| | | | Initial Image Quality | | | | |
|---|---|---|---|---|---|---|---|
| | Toner | Carrier | Graininess | Fogging | Unevenness of density | Carrier adhesion | Transferability (hollow character) |
| Ex. 1 | A | a | G1 | G1 | G1 | G1 | G1 |
| Ex. 2 | A | b | G1 | G1 | G1 | G1.5 | G1 |
| Ex. 3 | A | c | G1 | G1 | G1 | G1 | G1 |
| Ex. 4 | B | b | G1 | G1.5 | G1 | G1 | G1.5 |
| Ex. 5 | C | c | G1.5 | G1 | G1 | G1 | G1 |
| Comp. Ex. 1 | D | a | G4 | G1 | G2 | G1 | G1 |
| Comp. Ex. 2 | E | b | G1 | G3 | G2 | G1 | G2 |
| Comp. Ex. 3 | F | c | G4 | G1 | G1 | G2 | G1 |
| Comp. Ex. 4 | G | a | G3 | G2 | G2 | G1 | G2 |
| Comp. Ex. 5 | H | b | G3 | G1 | G3 | G1 | G4 |
| Comp. Ex. 6 | A | d | G1 | G3 | G1 | G2 | C1 |

TABLE 1-continued

| | | | | | | | |
|---|---|---|---|---|---|---|---|
| Comp. Ex. 7 | C | e | G2 | G1 | G2 | G1 | G1 |
| Comp. Ex. 8 | A | f | G2 | G1 | G2 | G1.5 | G1 |

| | Image Quality after 10,000-sheet Copying | | | | |
|---|---|---|---|---|---|
| | Graininess | Fogging | Unevenness of density | Carrier adhesion | Transferability (hollow character) |
| Ex. 1 | G1 | G1 | G1 | G1 | G1 |
| Ex. 2 | G1 | G1 | G1 | G2 | G1 |
| Ex. 3 | G1 | G1 | G1.5 | G1 | G1 |
| Ex. 4 | G1 | G1.5 | G1 | G2 | G1.5 |
| Ex. 5 | G2 | G1 | G1.5 | G1 | G1 |
| Comp. Ex. 1 | G4 | G1 | G3 | G1 | G1 |
| Comp. Ex. 2 | G1.5 | G4 | G4 | G2 | G4 |
| Comp. Ex. 3 | G5 | G1 | G1 | G1 | G1 |
| Comp. Ex. 4 | G4 | G4 | G2 | G1 | G2 |
| Comp. Ex. 5 | G4 | G1 | G3 | G1 | G5 |
| Comp. Ex. 6 | G3 | G4 | G4 | G4 | G1 |
| Comp. Ex. 7 | G2 | G3 | G4 | G1 | G1 |
| Comp. Ex. 8 | G2 | G3 | G4 | G2 | G1 |

Since the electrostatic-image developer of the present invention has the above-described composition, it is useful as an electrostatic-image developer containing a negatively charged color toner having a small diameter. The developer is excellent in electrification characteristics and developing properties and is capable of faithfully developing a latent image to give a high-quality image free from carrier adhesion, unevenness of density, toner fogging, etc. Therefore, by using the electrostatic-image developer of the present invention for image formation through magnetic brush development, images of excellent quality can be obtained.

While the invention has been described in detail and with reference to specific embodiments thereof, it will be apparent to one skilled in the art that various changes and modifications can be made therein without departing from the spirit and scope thereof.

What is claimed is:

1. An electrostatic-image developer which comprises a toner and a carrier comprising core particles coated with a coating resin, wherein the toner comprises toner particles having a volume-average particle diameter of from 3 to 9 μm and having a particle diameter distribution satisfying the following expressions (1) and (2):

$$D16v/D50v \leqq 1.475-0.036 \cdot D50v \quad (1)$$

$$D50p/D84p \leqq 1.45 \quad (2)$$

(wherein D16v and D50v represent, in terms of absolute value, a cumulative 16% diameter (μm) and a cumulative 50% diameter (μm), respectively, of a cumulative volume particle diameter distribution of the toner particles depicted from the maximum particle diameter and D50p and D84p represent, in terms of absolute value, a cumulative 50% diameter (μm) and a cumulative 84% diameter (μm), respectively, of a cumulative population particle diameter distribution of the toner particles depicted from the maximum particle diameter), and at least 20% of the total surface area of the toner particles is covered with (a) an external additive having an average particle diameter of from 20 nm to 100 nm, excluding 100 nm, and at least 40% of the total surface area of the toner particles is covered with (b) an external additive having an average particle diameter of from 7 nm to 20 nm, excluding 20 nm, the total percentage of the coverage with the two external additives is from 60% to 120%, excluding 120%, based on the total surface area of the toner particles, and wherein the core particles of the carrier are magnetic particles formed from a composition comprising 100 parts by weight of a ferrite component represented by the following formula (3):

$$(M_yO)_{100-x}(Fe_2O_3)_x \quad (3)$$

(wherein M represents at least one metal atom selected from the group consisting of Li, Mg, Ca and Mn; x represents a mole percentage of 45 to 95%; and y represents 1 or 2) and from 0.01 to 10 parts by weight of an oxide of at least one element selected from the group consisting of Groups IA, IIA, IIIA, IVA, VA, IIIB, IVB, and VB of the periodic table by granulating the composition and sintering the granules, and the magnetic particles have a silicon content of from 500 to 5,000 ppm.

2. The electrostatic-image developer according to claim 1, wherein the oxide is a metal oxide selected from the group consisting of $Li_2O$, BaO, SrO, $Al_2O_3$, $TiO_2$, $SiO_2$, $SnO_2$ and $Bi_2O_5$.

3. The electrostatic-image developer according to claim 1, wherein the oxide is a metal oxide selected from the group consisting of $Li_2O$, SrO, $Al_2O_3$, $SiO_2$ and $Bi_2O_5$.

4. The electrostatic-image developer according to claim 1, wherein the magnetic particle has a silicon content of 1000 to 3000 ppm.

5. The electrostatic-image developer according to claim 1, wherein the carrier is coated with the coating resin in an amount of 0.1 to 5% by weight based on the weight of the carrier.

6. The electrostatic-image developer according to claim 1, wherein the carrier is coated with the coating resin in an amount of 0.3 to 3% by weight based on the weight of the carrier.

7. The electrostatic-image developer according to claim 1, wherein the coating resin is a homopolymer or a copolymer comprising a monomer selected from the group consisting of a fluorinated vinyl monomer, styrene, a derivative of styrene, an aliphatic α-methylene monocarboxylic acid and an alkyl ester of an aliphatic α-methylene monocarboxylic acid, or a silicone resin.

8. The electrostatic-image developer according to claim 1, wherein the developer comprises a color toner.

9. The electrostatic-image developer according to claim 1, wherein the toner comprises a binder resin comprising polyester.

10. An image forming method comprising:

forming a latent image on a latent-image holding member;

developing the latent image using a developer to form a toner image; and transferring the toner image to a transferring member, wherein the developer is the developer as claimed in claim 1.

11. The image forming method according to claim 10, wherein the oxide is a metal oxide selected from the group consisting of $Li_2O$, BaO, SrO, $Al_2O_3$, $TiO_2$, $SiO_2$, $SnO_2$ and $Bi_2O_5$.

12. The image forming method according to claim 10, wherein the oxide is a metal oxide selected from the group consisting of $Li_2O$ SrO, $Al_2O_3$, $SiO_2$ and $Bi_2O_5$.

13. The image forming method according to claim 10, wherein the magnetic particle has a silicon content of 1000 to 3000 ppm.

14. The image forming method according to claim 10, wherein the carrier is coated with the coating resin in an amount of 0.1 to 5% by weight based on the weight of the carrier.

15. The image forming method according to claim 10, wherein the carrier is coated with the coating resin in an amount of 0.3 to 3% by weight based on the weight of the carrier.

16. The image forming method according to claim 10, wherein the coating resin is a homopolymer or a copolymer comprising a monomer selected from the group consisting of a fluorinated vinyl monomer, styrene, a derivative of styrene, an aliphatic α-methylene monocarboxylic acid and an alkyl ester of an aliphatic s-methylene monocarboxylic acid, or a silicone resin.

17. The image forming method according to claim 10, wherein the developer comprises a color toner.

18. The image forming method according to claim 10, wherein the toner comprises a binder resin comprising polyester.

* * * * *